US010711537B2

(12) United States Patent
Kuan et al.

(10) Patent No.: US 10,711,537 B2
(45) Date of Patent: Jul. 14, 2020

(54) SELF-INSTALLING CONDUCTOR GUIDE SUPPORT FRAME SYSTEM AND METHOD

(71) Applicant: TECHNIP FRANCE, Courbevoie (FR)

(72) Inventors: Eng Yeow Kuan, Kuala Lumpur (MY); Kien Peng Yee, Kuala Lumpur (MY); Fathieah Kiprawi, Kuala Lumpur (MY)

(73) Assignee: TECHNIP FRANCE, Courbevoie (FR)

( * ) Notice: Subject to any disclaimer, the term of this patent is extended or adjusted under 35 U.S.C. 154(b) by 0 days.

(21) Appl. No.: 16/488,080

(22) PCT Filed: Feb. 26, 2018

(86) PCT No.: PCT/EP2018/054697

§ 371 (c)(1),
(2) Date: Aug. 22, 2019

(87) PCT Pub. No.: WO2018/154121

PCT Pub. Date: Aug. 30, 2018

(65) Prior Publication Data

US 2019/0376351 A1 Dec. 12, 2019

(30) Foreign Application Priority Data

Feb. 27, 2017 (MY) ..... PI 2017000291

(51) Int. Cl.
*E02B 17/02* (2006.01)
*E21B 19/00* (2006.01)
*E21B 19/24* (2006.01)

(52) U.S. Cl.
CPC ..... *E21B 19/004* (2013.01); *E02B 17/021* (2013.01); *E21B 19/24* (2013.01)

(58) Field of Classification Search
CPC ..... E21B 19/004; E21B 19/24; E02B 17/021
See application file for complete search history.

(56) References Cited

U.S. PATENT DOCUMENTS 4,244,663 A 1/1981 Croghan
4,739,840 A * 4/1988 Cox ..... E02B 17/00 175/9

(Continued)

FOREIGN PATENT DOCUMENTS

CN 204266186 4/2015
CN 204266186 U * 4/2015

(Continued)

OTHER PUBLICATIONS

Notification of Transmittal of the International Search Report and Written Opinion of the International Searching Authority—The European Patent Office—dated May 15, 2018 for International Application No. PCT/EP2018/054697, 14 pages.

*Primary Examiner* — Benjamin F Fiorello
(74) *Attorney, Agent, or Firm* — Jackson Walker, LLP

(57) ABSTRACT

A system and a method for an offshore platform that is self-installing, not requiring use of a heavy lift vessel for installation at a site. The system has a built-in, retractable, suspended, conductor guide support frame assembly coupled to the hull of the platform and serves as lateral guide/support for the well conductors/casings during operational conditions. The conductor guide support frame assembly is generally raised during wet tow/transit. At the site, the conductor guide support frame assembly is lowered and secured into the sea to its designated elevation. The conductor guide support frame assembly generally remains suspended from the hull and does not need to extend all the way to the seabed foundation. After operations are completed, the conductor guide support frame assembly is generally raised up relative to the hull, and the whole platform with the conductor guide support frame assembly relocated for reuse at a new site.

14 Claims, 7 Drawing Sheets

(56) References Cited

U.S. PATENT DOCUMENTS

| | | | | |
|---|---|---|---|---|
| 5,551,801 | A * | 9/1996 | Gallaher | E02B 17/021 405/196 |
| 6,164,234 | A | 12/2000 | Manschot et al. | |
| 8,689,881 | B2 | 4/2014 | Nadarajah et al. | |
| 2005/0047872 | A1* | 3/2005 | Baugh | E02B 17/021 405/158 |
| 2015/0252634 | A1* | 9/2015 | Golovinskij | E02B 17/021 166/360 |
| 2015/0315853 | A1* | 11/2015 | Pollack | E21B 17/012 405/224.4 |
| 2015/0354164 | A1* | 12/2015 | Kok Seng | E02D 27/525 405/224 |
| 2016/0153251 | A1* | 6/2016 | Frith | E21B 19/16 166/380 |

FOREIGN PATENT DOCUMENTS

| | | | | |
|---|---|---|---|---|
| EP | 2204497 | | 7/2010 | |
| WO | WO-9641922 | A1 * | 12/1996 | B63B 15/00 |
| WO | 2000/058598 | | 10/2000 | |
| WO | WO-0058598 | A1 * | 10/2000 | E21B 17/012 |

* cited by examiner

SELF-INSTALLING CONDUCTOR GUIDE SUPPORT FRAME SYSTEM AND METHOD

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates to shallow water, self-installing, fixed platform for hydrocarbon drilling and production. More specifically, the disclosure relates to retractable conductor guide support frame systems for conductors for offshore platforms and methods of use.

Description of the Related Art

As the energy industry continues to provide hydrocarbons, new technology is needed to maintain or reduce exploration and development costs. One of the constraints is the availability and high rental costs of derrick barges, heavy lift cranes on barges, and other equipment needed to install and possibly relocate an offshore platform to different sites. To counteract this constraint, the industry has used in recent history platforms that are self-installing and can be relocated to multiple sites without the use of a derrick barge or heavy lift crane on a barge.

U.S. Pat. No. 6,164,234 describes an assembly of a jack-up platform that is supported by a storage tank. The storage tank is adapted to receive a hydrocarbon fluid from a feed through pipe that extends above the water surface and is connectable to a platform.

U.S. Pat. No. 8,689,881 describes a self-installing offshore platform or rig that is relocatable and the method of installing a wellhead platform (in the form of wellhead deck and subsea conductor frame). The self-installing unit, which can pre-installed with a detachable wellhead platform, is to be self-installed onto the seabed without the use of a heavy lift crane barge and/or jack-up drilling rig. The wellhead platform can be detached from the self-installing unit and can be utilized for further drilling, well intervention, production and/or abandonment.

EP 2 204 497 A1 describes a method for installing a floating offshore arrangement having vertical supports on a support structure, and a floating platform that is releasably attachable between a first position close to the bottom end of the supports and a second position on the supports at a distance from the support structure close to the bottom end of the support, and a guide means for pipes. The offshore arrangement is moved to a desired location while floating, and the support structure is lowered to the ocean floor. The platform is lifted to a height above mean sea level. During transportation, the guide means is supported on the support structure. After a predetermined lowering stroke of the support structure, the support of the guide means is taken over by the platform when the guide means reaches the height of the platform as the support structure is lowered, so that the guide means raises and lowers with the platform.

There remains a need for a self-installing platform system to support both the topside processing facilities and dry tree wellhead facilities in the form of a retractable conductor guide support frame assembly that can be installed independently without the need of derrick barge/heavy lift vessel or jack-up drilling rig for its installation at a site, can be supported from the hull during installation and operational mode, and be reusable to support new conductors when the platform is relocated to another site.

BRIEF SUMMARY OF THE INVENTION

The present disclosure provides a system and a method for an offshore platform that is self-installing and does not require the use of a heavy lift vessel for its installation at a site. It has a built-in, retractable, suspended, structural guide support frame assembly that is coupled to the hull of the platform and serves as lateral guide/support for the well conductors/casings during operational conditions. The conductor guide support frame assembly is generally raised during wet tow/transit. At the site, the conductor guide support frame assembly is lowered from a raised position into the sea to its designated elevation and can be secured at that elevation relative to the hull by means of a structural or mechanical fixation system. The conductor guide support frame assembly generally remains suspended from the hull and does not to extend all the way to the seabed or connect to the platform's foundation. After the platform has served its intended service life at the site, the conductor guide support frame assembly is generally raised up relative to the hull, and the whole platform with the conductor guide support frame assembly can be relocated whereby the conductor guide support frame assembly is reusable to support new conductors at the new site.

The disclosure provides a method of deploying a self-installing offshore platform at a site, comprising: floating the offshore platform to a site, the offshore platform having a hull, a plurality of jack-up legs coupled to the hull, and a conductor guide support frame assembly slidably coupled to the hull, the assembly having a structural frame and at least one conductor guide coupled to the structural frame; lowering the jack-up legs to be supported by a foundation; raising the hull above a mean sea level; lowering the conductor guide support frame assembly relative to the hull; suspending the conductor guide support frame assembly at a predetermined height from the hull; inserting a conductor through the conductor guide; and extending the conductor to the seabed.

The disclosure also provides a self-installing offshore platform, comprising: a hull; a plurality of jack-up legs coupled to the hull and configured to support the hull above a seabed and raise the hull above a mean sea level; and a conductor guide support frame assembly slidably coupled to the hull that is configured to be raised or lowered independently of an elevation of the hull, the assembly comprising a structural frame and a least one conductor guide coupled to the frame, the conductor guide support frame assembly configured to allow a conductor to pass through the conductor guide to the seabed while the conductor guide support frame assembly is suspended from the hull above the seabed.

DETAILED DESCRIPTION

Figure 1B:
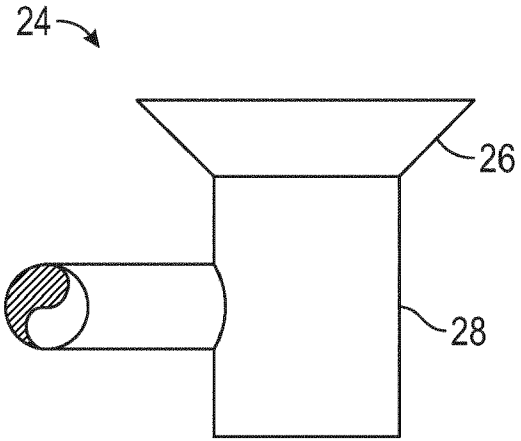
FIG. 1B is a schematic side view of an exemplary conductor guide for the conductor guide support frame assembly of the self-installing offshore platform of FIG. 1A.

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Further, the various methods and embodiments of the system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure. Unless the context requires otherwise, the term "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The order of steps can occur in a variety of sequences unless otherwise specifically limited. The various steps described herein can be combined with other steps, interlineated with the stated steps, and/or split into multiple steps. Some elements are nominated by a device name for simplicity and would be understood to include a system or a section, such as a "jack" would encompass a control mechanism or system for raising and lowering, and so forth. Other and further embodiments utilizing one or more aspects of the invention described herein can be devised without departing from the spirit of Applicant's invention. For example, various combinations of the embodiments and other embodiments can be made, various relative sizes, shapes, and placement of the conductor guide support frame, conductor guide(s), conductor(s), leg(s), hull, foundation(s) and any portions thereof can vary, the manner of supporting the conductor guide(s), conductor(s), leg(s), and hull can vary, the manner of coupling of the conductor guide(s), conductor(s), and leg(s) can vary, and other variations can occur in keeping within the scope of the claims.

The present disclosure provides a system and a method for an offshore platform that is self-installing and does not require the use of a heavy lift vessel for its installation at a site. It has a built-in, retractable, suspended, conductor guide support frame assembly that is coupled to the hull of the platform and serves as lateral guide/support for the well conductors/casings during operational conditions. The conductor guide support frame assembly is generally raised during wet tow/transit of the self-installing platform. At the site, the conductor guide support frame assembly is lowered from the hull into the sea to its designated elevation and can be secured at that elevation relative to the hull by means of a structural or mechanical fixation system. The conductor guide support frame assembly generally remains suspended from the hull and does not need to extend all the way to the seabed or connect to the platform's foundation. After the platform has served its intended service life at the site, the conductor guide support frame assembly is generally raised up relative to the hull, and the whole platform with the conductor guide support frame assembly can be relocated whereby the conductor guide support frame assembly is reusable to support new conductors at a new site.

Figure 1A:
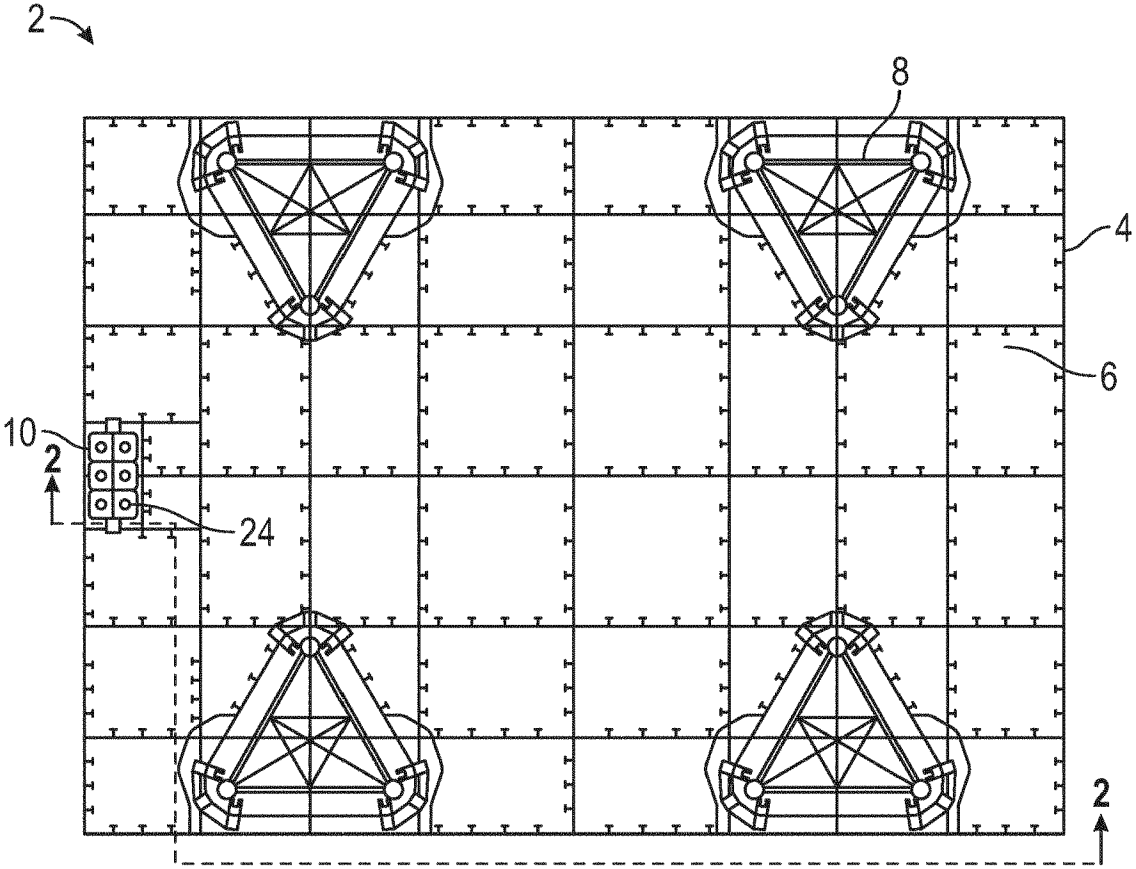
FIG. 1A is a schematic top view of a self-installing offshore platform according to the invention.
Figure 2:
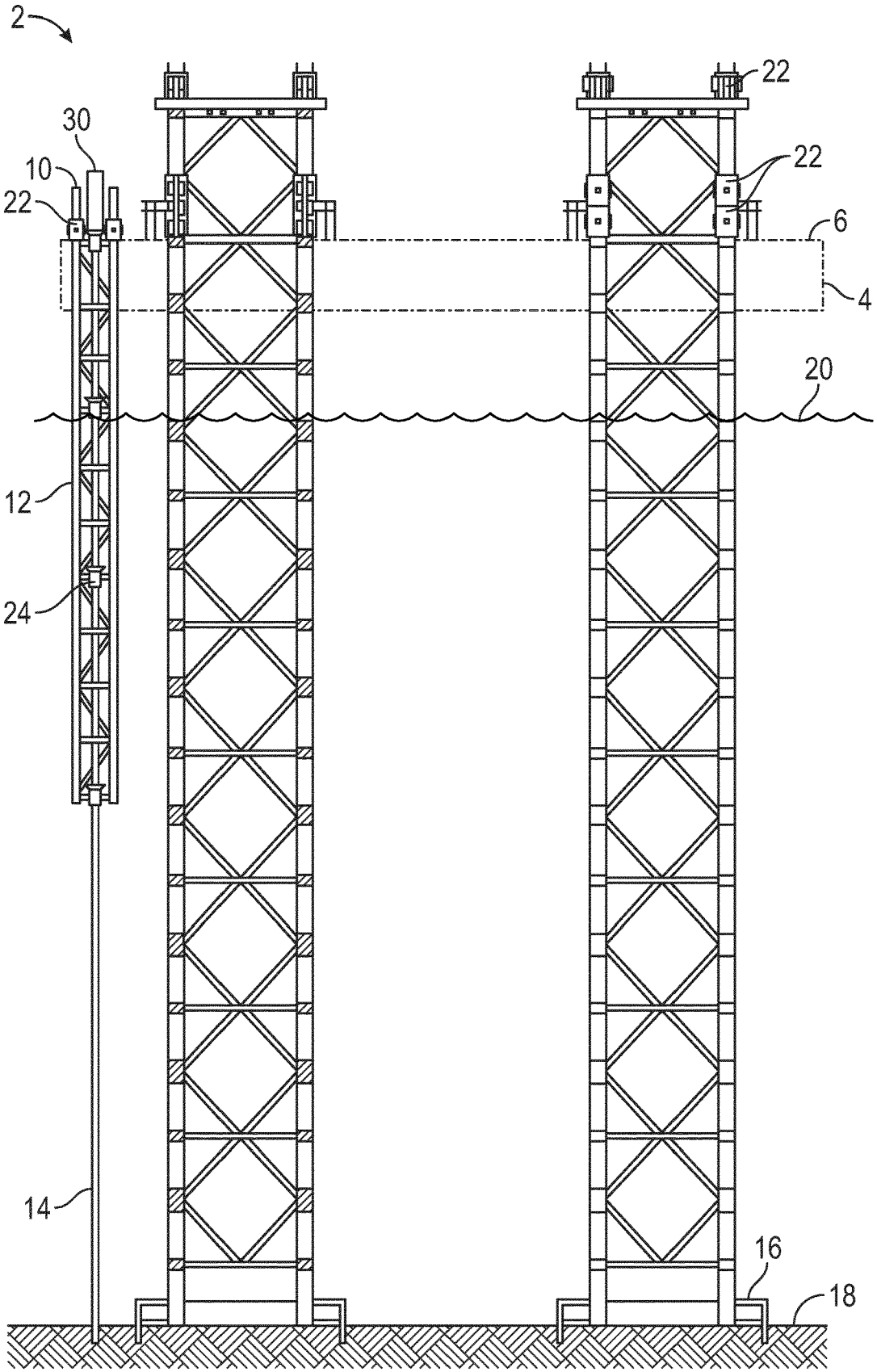
FIG. 2 is a schematic elevational view of the self-installing offshore platform of FIG. 1A.

FIG. 1A is a schematic top view of a self-installing offshore platform according to the invention. FIG. 1B is a schematic side view of an exemplary conductor guide for the conductor guide support frame assembly of the self-installing offshore platform of FIG. 1A. FIG. 2 is a schematic elevational view of the self-installing offshore platform of FIG. 1A. The self-installing offshore platform generally includes at least a hull 4 having a deck 6. The term "self-installing" is meant to not require the use of a heavy lift vessel or jack-up drilling rig for its installation at the site. The deck 6 can be coupled to the hull 4 directly or indirectly through support members or other structure. The deck 6 generally supports operational equipment, such as wellheads, equipment, pipings, valves, utilities, storage space for components, and at times accommodation quarters and facilities for crews. One or more platform support legs 8 are slidably coupled to the hull 4 to be raised and lowered relative to the hull. The term "leg" is broadly defined to include any extendable support structure that can be used to support the hull for operations. The legs 8 can be coupled to a foundation 16 that can rest on the seabed 18. The foundation can vary and can include, for example and without limitation, one or more spud cans coupled to the legs, one or more suction piles or other pile structures, a gravity base, and in some instances, a portion of the seabed on which the legs are supported. Once the legs are supported by the foundation 16, the hull 4 can be raised relative to the legs 8 above a mean sea level 20 to an operational elevation, such as during hydrocarbon drilling or production operations.

The self-installing offshore platform 2 further includes a retractable conductor guide support frame assembly 10 coupled to the hull 4 that is also self-installing. The frame assembly can be pre-installed onto the platform at a fabrication yard. The coupled, retractable, suspended, conductor guide support frame assembly removes the need for a separate, standalone wellhead platform (typically in the form of a wellhead deck with subsea structure or subsea template seated on the seabed) that is typically located adjacent to a main process platform in close proximity. Thus, it eliminates the need of a separate wellhead platform as well as separate installation of the wellhead platform. The traditional two separate installations of the wellhead platform and the main process platform respectively will face difficulties and challenges to install the two platforms at site in close proximity to each other that requires high precision and small installation tolerances.

In the present invention, the coupled suspended conductor guide support frame assembly allows the conductors to move in-compliance with the platform and thus avoid complicated force and displacement interactions that may otherwise arise between the main process platform and the adjacent wellhead platform. The retractable suspended conductor guide support frame assembly also removes the need for top-tensioned conductor system that imposes significant additional design loads onto an offshore platform that utilizes the top-tensioned conductor concept.

The conductor guide support frame assembly 10 comprises a conductor guide support frame 12 as a structural frame, such as having lattice truss frame members, plates, or a combination thereof, one or more conductor guides 24, associated couplers, clamps, rubber linings, rubber guides, sacrificial anodes, and other hardware to support one or more conductors 14 passing therethrough toward the seabed 18. The conductors 14 can be casings, pipes, risers, and other tubular goods. The conductors are to be used in drilling a well such as to encase a borehole, to provide a flow path for hydrocarbons to the offshore platform 2 that are produced from the well, and/or for other well-related purposes. In at least some embodiments, the conductor guide support frame assembly 10 is coupled to a jack 22. The term "jack" is broadly understood to include any raising and/or lowering mechanism that would be known to those with ordinary skill in the art for raising and/or lowering a structure on an offshore platform, and can include, for example, strand jacks, winches, gears, sprockets and chains, hydraulic motors, hydraulic cylinders, and other mechanisms for moving structures in elevation. In at least one embodiment, a conductor guide 24 is formed with a cone 26 having a tapered cross-sectional area to help the conductor's initial alignment into the conductor guide. Further, a tube 28 can be coupled to the cone 26 to further support a conductor laterally as it is assembled in the conductor guide.

Figure 3C:
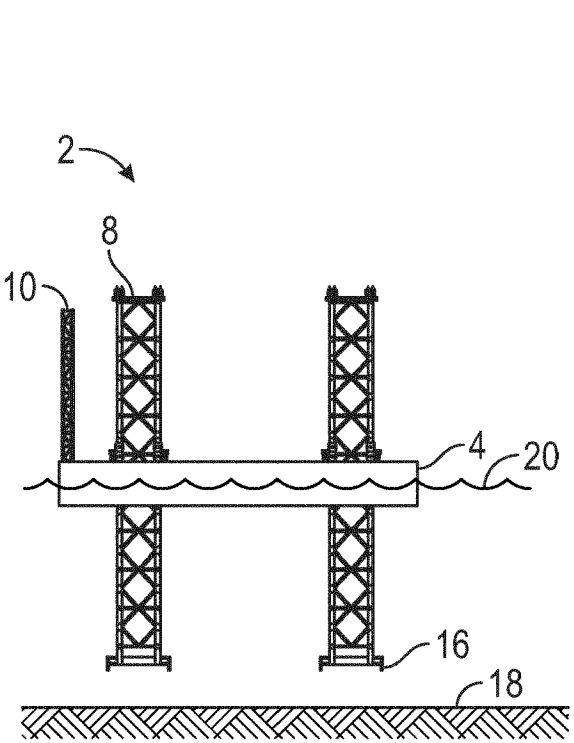
FIG. 3C is a schematic elevational view of the self-installing offshore platform with exemplary legs to support the offshore platform partially lowered toward the seabed with the conductor guide support frame assembly at raised position.

FIGS. 3A-31 illustrate an exemplary sequence for using the self-installing offshore platform is to be installed (or commissioned) at a site. FIG. 3A is a schematic elevational view of the self-installing offshore platform in wet tow/floating position with the conductor guide support frame assembly at raised position. In this exemplary embodiment, the offshore platform 2 with the hull 4 can float in the sea generally at mean sea level 20. The conductor guide support frame assembly 10 is generally pre-installed to the self-installing offshore platform, such as at a fabrication yard for the offshore platform. The legs 8 can be in a raised position to facilitate wet tow/transit.

Figure 3B:
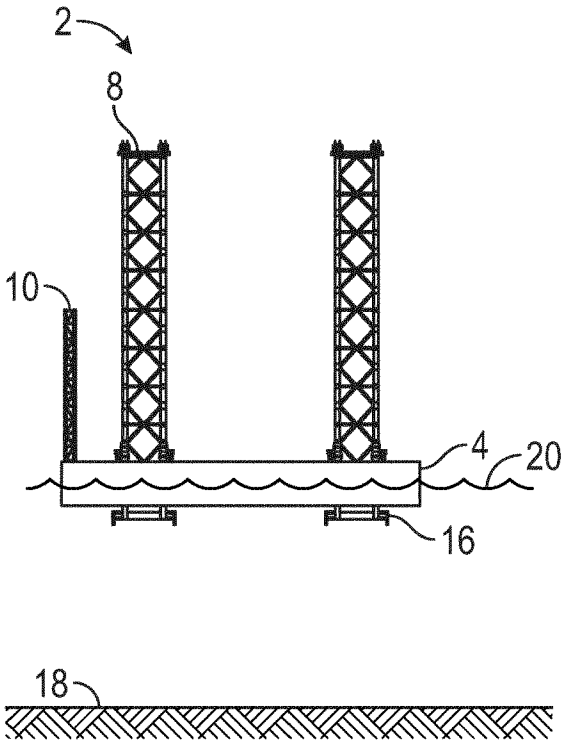
FIG. 3B is a schematic elevational view of the self-installing offshore platform at a designated site location with the conductor guide support frame assembly at raised position.
Figure 3A:
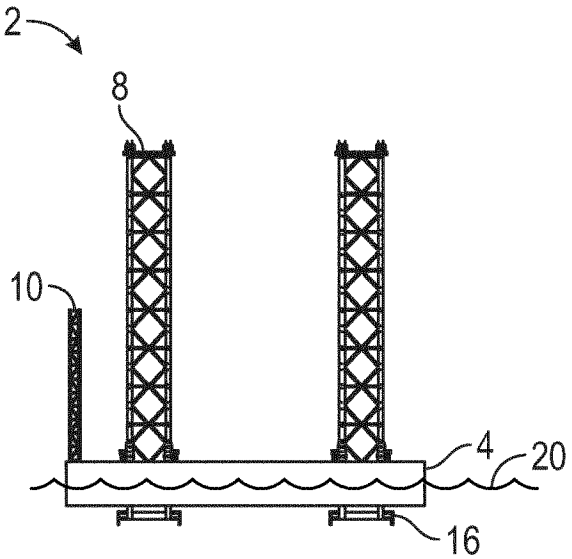
FIG. 3A is a schematic elevational view of the self-installing offshore platform in wet tow/floating position with the conductor guide support frame assembly at raised position.

FIG. 3B is a schematic elevational view of the self-installing offshore platform at a designated site location with the conductor guide support frame assembly at raised position. The offshore platform 2 can arrive at the intended destination site above the seabed 18 to be drilled, produced, or for other operations.

Figure 3F:
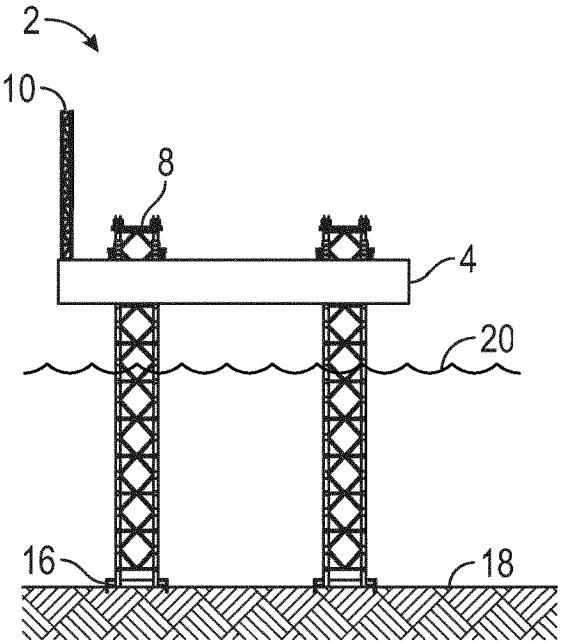
FIG. 3F is a schematic elevational view of the self-installing offshore platform with the hull fully raised to a predetermined elevation above the mean sea level through the support of the exemplary legs with the conductor guide support frame assembly at raised position.

FIG. 3C is a schematic elevational view of the self-installing offshore platform with exemplary legs to support the offshore platform partially lowered toward seabed with the conductor guide support frame assembly at raised position. FIG. 3D is a schematic elevational view of the self-installing offshore platform with the exemplary legs positioned on the seabed to support the offshore platform with the conductor guide support frame assembly at raised position. While the hull 4 is afloat, the legs 8 can be lowered toward the seabed 18 using the jacks 22. In this embodiment, the foundation 16 can include spud cans pre-installed with the legs. Other types of foundations 16 can be used. The conductor guide support frame assembly 10 can remain in a raised position while the legs 8 are lowered to the seabed and/or foundation.

Figure 3E:
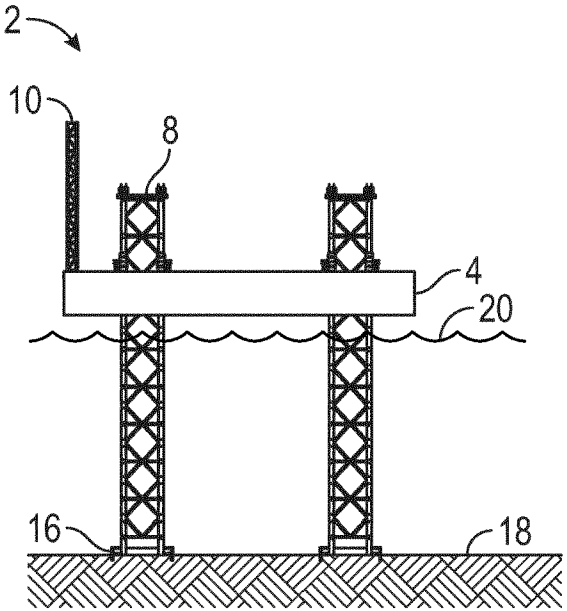
FIG. 3E is a schematic elevational view of the self-installing offshore platform with the hull partially raised above mean sea level through the support of the exemplary legs with the conductor guide support frame assembly at raised position.
Figure 3D:
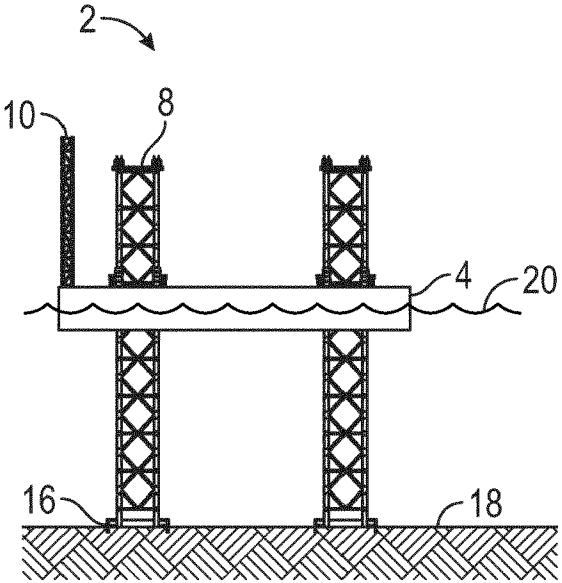
FIG. 3D is a schematic elevational view of the self-installing offshore platform with the exemplary legs positioned on the seabed to support the offshore platform with the conductor guide support frame assembly at raised position.

FIG. 3E is a schematic elevational view of the self-installing offshore platform with the hull partially raised above mean sea level through the support of the exemplary legs with the conductor guide support frame assembly at raised position. FIG. 3F is a schematic elevational view of the self-installing offshore platform with the hull fully raised to a predetermined elevation above the mean sea level through the support of the exemplary legs with the conductor guide support frame assembly at raised position. With the legs 8 able to support the hull 4 from the seabed, further "lowering" of the legs 8 relative to the hull 4 can effectively raise the hull 4 above the mean sea level 20 until the hull 4 is at a predetermined operational elevation.

Figure 3I:
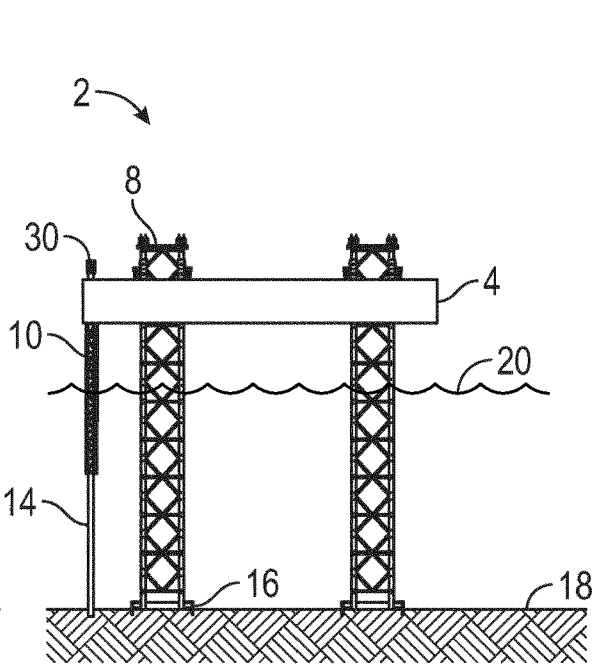
FIG. 3I is a schematic elevational view of the self-installing offshore platform with the hull fully raised to a predetermined elevation above the mean sea level through the support of the exemplary legs, and the conductor guide support frame assembly in the fully lowered predetermined position with one or more conductors spanning from the seabed to the top of hull through the conductor guide support frame assembly with wellhead equipment at the top of the conductor.
Figure 3H:
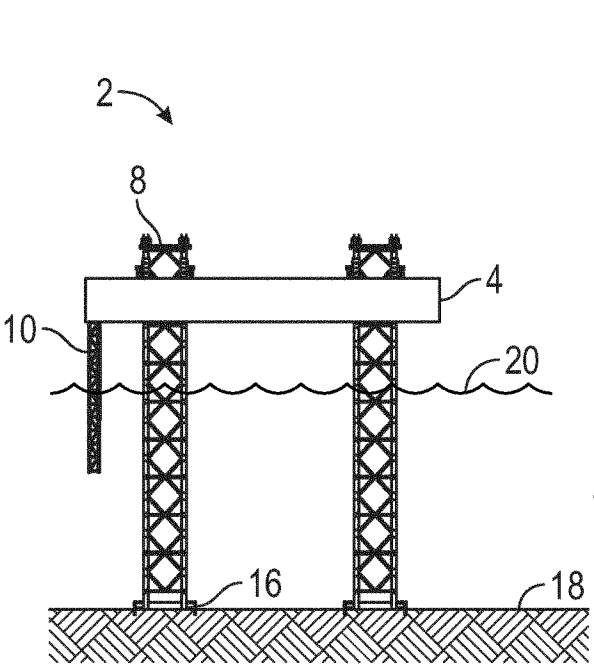
FIG. 3H is a schematic elevational view of the self-installing offshore platform with the hull fully raised to a predetermined elevation above the mean sea level through the support of the exemplary legs and the conductor guide support frame assembly fully lowered to a predetermined elevation.
Figure 3G:
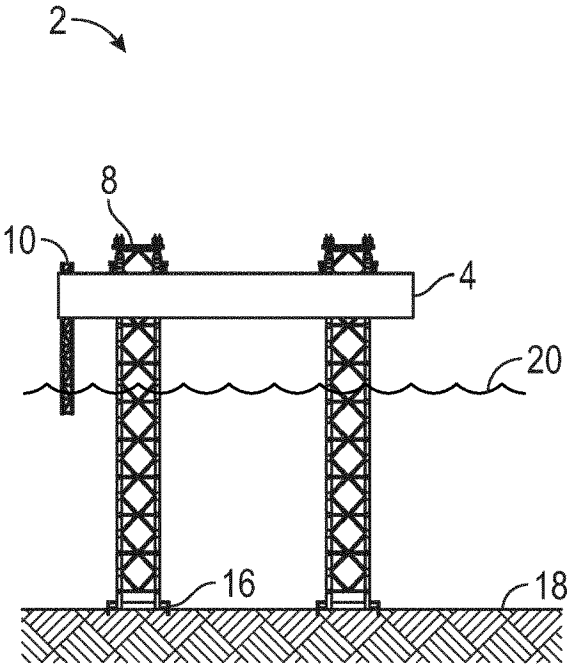
FIG. 3G is a schematic elevational view of the self-installing offshore platform with the hull fully raised to a predetermined elevation above the mean sea level through the support of the exemplary legs and the conductor guide support frame assembly at partially lowered position.

FIG. 3G is a schematic elevational view of the self-installing offshore platform with the hull fully raised to a predetermined elevation above the mean sea level through the support of the exemplary legs and the conductor guide support frame assembly at partially lowered position. FIG. 3H is a schematic elevational view of the self-installing offshore platform with the hull fully raised to a predetermined elevation above the mean sea level through the support of the exemplary legs and the conductor guide support frame assembly fully lowered to a predetermined elevation. The conductor guide support frame assembly 10 can be fully lowered to an operational position relative to the elevation of the hull 4. Generally, the conductor guide support frame assembly 10 can be at least partially lowered after the hull is stabilized at the operational elevation shown in FIG. 3F. The conductor guide support frame assembly 10 can remain suspended from the hull 4 during operations.

FIG. 3I is a schematic elevational view of the self-installing offshore platform with the hull fully raised to a predetermined elevation above the mean sea level through the support of the exemplary legs, and the conductor guide support frame assembly in the fully lowered predetermined position with one or more conductors spanning from the seabed to the top of hull through the conductor guide support frame assembly with wellhead equipment at the top of the conductor. The conductor 14 can be inserted through the conductor guide 24 described in reference to FIG. 1B toward the seabed for hydrocarbon operations. In at least one embodiment, the conductor can be a casing that is installed during drilling operations in the borehole of the well. In another embodiment, the conductor can be a riser or other tubular member having a flow path to facilitate the extraction of the hydrocarbons from subsurface layers of the seabed 18 up to the hull 4 and equipment installed thereon. Such equipment can include, for example, wellhead equipment 30 installed on the top (or other appropriate position) of the conductor guide support frame assembly 10.

Figure 4C:
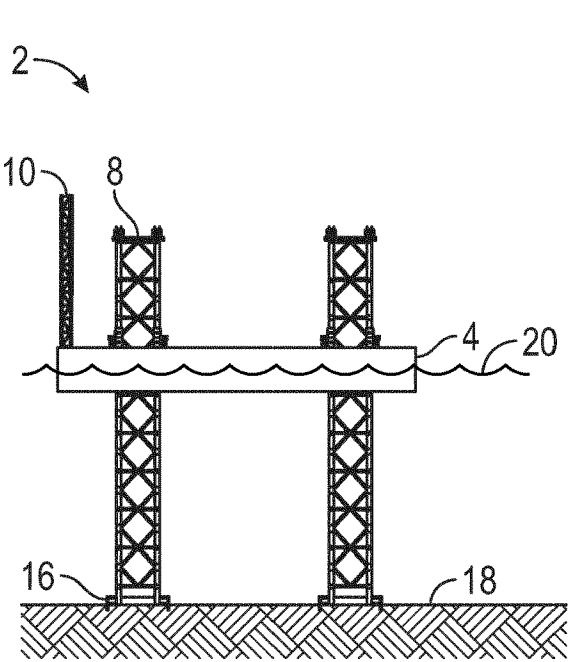
FIG. 4C is a schematic elevational view of the self-installing offshore platform of FIG. 4B with the hull lowered to its floating elevation with the conductor guide support frame assembly at raised position.
Figure 4B:
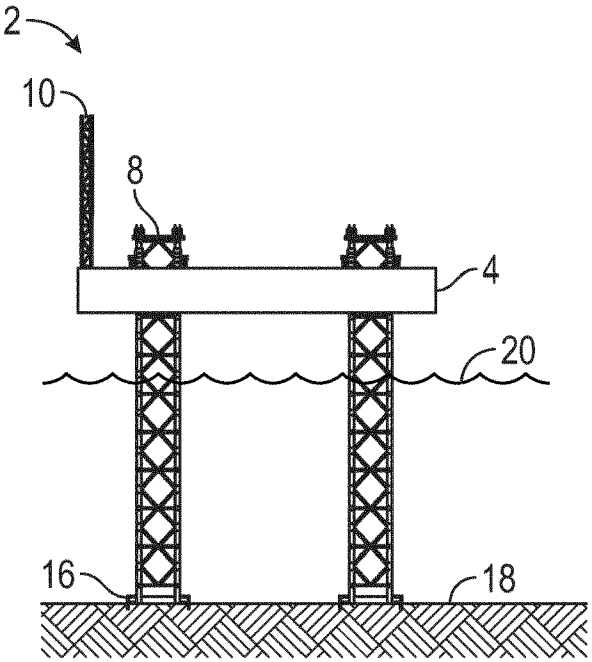
FIG. 4B is a schematic elevational view of the self-installing offshore platform of FIG. 4A with the conductor guide support frame assembly at raised position.
Figure 4A:
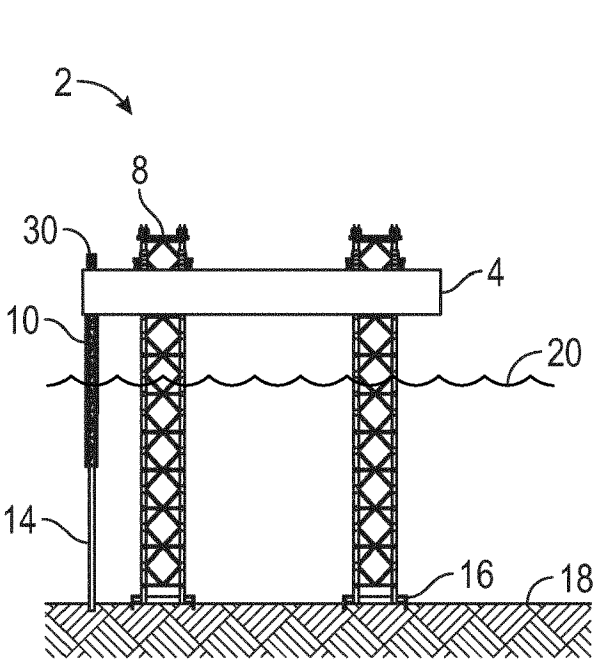
FIG. 4A is a schematic elevational view of the self-installing offshore platform of FIG. 3I that is ready for decommissioning from the site.

FIG. 4A is a schematic elevational view of the self-installing offshore platform of FIG. 3I that is ready for decommissioning from the site. For decommissioning, use of the conductor 14 is terminated. For example, decommissioning can be appropriate, the well is plugged or abandoned, the wellhead equipment 30 is removed, or production is stopped. The conductor 14 is generally disconnected from the seabed or from the conductor guide support frame assembly 10.

FIG. 4B is a schematic elevational view of the self-installing offshore platform of FIG. 4A with the conductor guide support frame assembly at raised position. The conductor guide support frame assembly 10 can be raised relative to the hull 4 independent of the elevation of the hull.

FIG. 4C is a schematic elevational view of the self-installing offshore platform of FIG. 4B with the hull lowered to its floating elevation with the conductor guide support frame assembly at raised position. The hull 4 can be lowered to mean sea level 20, while the conductor guide support frame assembly 10 is at raised position. The hull 4 can be lowered in elevation by retracting the legs 8 back from the seabed 18.

Figure 4D:
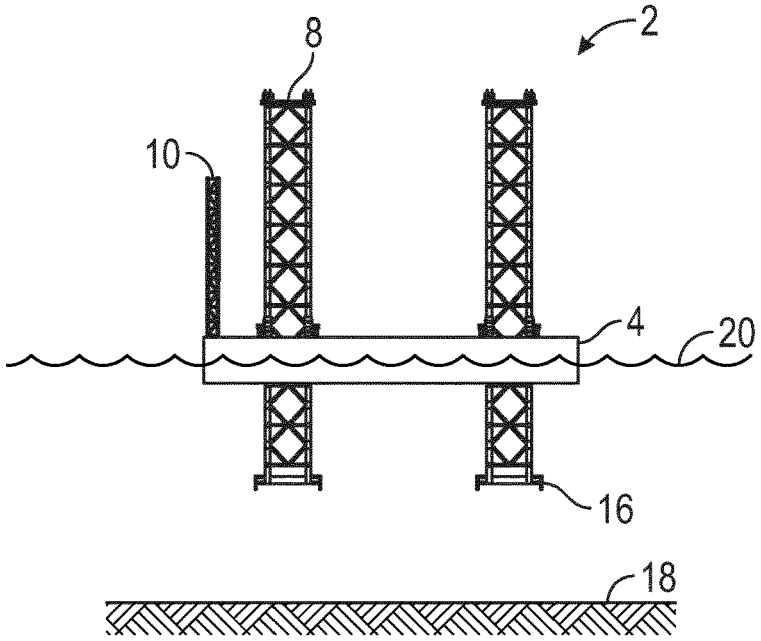
FIG. 4D is a schematic elevational view of the self-installing offshore platform of FIG. 4C with the exemplary legs partially raised above the seabed with the conductor guide support frame assembly at raised position.
Figure 4E:
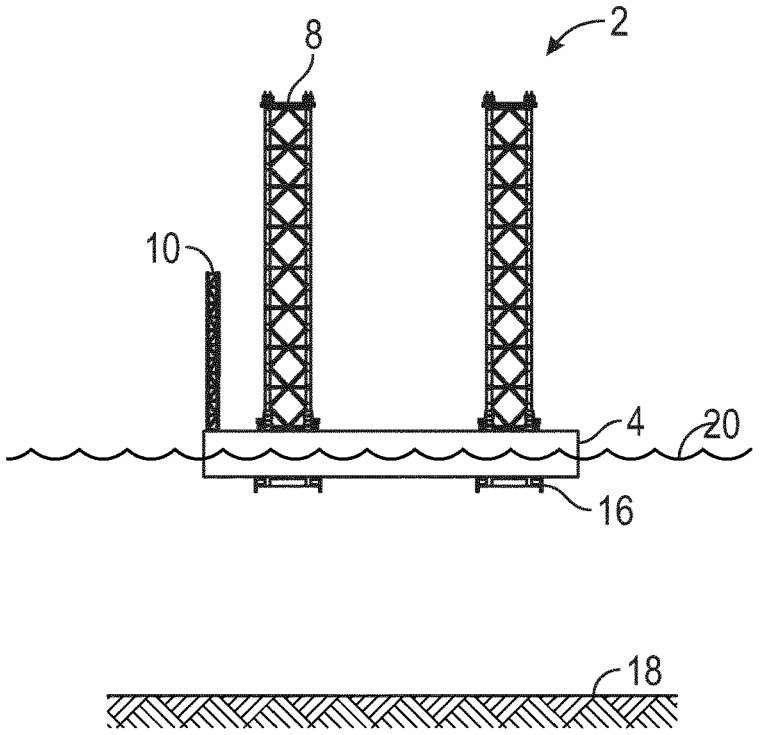
FIG. 4E is a schematic elevational view of the self-installing offshore platform of FIG. 4D with exemplary legs fully raised above the seabed for wet tow with the conductor guide support frame assembly at raised position.

FIG. 4D is a schematic elevational view of the self-installing offshore platform of FIG. 4C with exemplary legs partially raised above the seabed with the conductor guide support frame assembly at raised position. FIG. 4E is a schematic elevational view of the self-installing offshore platform of FIG. 4D with exemplary legs fully raised above the seabed for wet tow with the conductor guide support frame assembly at raised position. The legs can continue to be raised to a towing/floating position relative to the hull 4. Water jets or pressurized air may assist in extracting the foundation 16 on the legs 8 from the seabed 18. In some embodiments, the foundation 16 can be decoupled from the legs 8 and remain on the seabed 18. If appropriate, the legs 8 can be temporarily secured in position by fasteners, weldments, or other securing devices.

The conductor guide support frame assembly 10 can thus be lowered and raised relative to the hull independently of the elevation of the hull 4. The continued coupling of the conductor guide support frame assembly 10 with the hull 4 helps eliminate the need for accurate relative positional tolerances in the case of having a separate wellhead platform during operations. The continued coupling of the conductor guide support frame assembly with the hull eliminates the need for separate installations of a separate wellhead platform (typically in the form of a wellhead deck with subsea structure or subsea template) on the seabed, as is typically performed. Further, the continued coupling facilitates the speed of commissioning and decommissioning of the offshore platform at a given site for movement to another site.

Other and further embodiments utilizing one or more aspects of the invention described above can be devised without departing from the spirit of Applicant's invention. The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalents of the following claims.

What is claimed is:

1. A method of deploying a self-installing offshore platform at a site, comprising:

floating the offshore platform to a site, the offshore platform having a hull, a plurality of jack-up legs coupled to the hull, and a conductor guide support frame assembly slidably coupled to the hull, the assembly having a structural frame and at least one conductor guide coupled to the structural frame;

lowering the jack-up legs to be supported by a foundation that is configured to rest on a seabed;

raising the hull above a mean sea level with the jack-up legs;

lowering the conductor guide support frame assembly to a fixed elevation relative to the hull;

suspending the conductor guide support frame assembly at a predetermined height from the hull;

inserting a conductor through the conductor guide; and extending the conductor to be coupled to the seabed at a fixed elevation relative to the conductor guide support frame.

2. The method of claim 1, further comprising flowing hydrocarbons from the seabed through the conductor in the conductor guide while the conductor guide support frame assembly is suspended from the hull above the seabed.

3. The method of claim 1, wherein the structural frame comprises a lattice truss frame.

4. The method of claim 1, further comprising:

terminating use of the conductor in the conductor guide support frame assembly;

raising the conductor guide support frame assembly relative to the hull;

lowering the hull toward the mean sea level; and raising the jack-up legs.

5. The method of claim 1, moving the offshore platform to another site with the conductor guide support frame assembly.

6. The method of claim 1, further comprising providing the foundation.

7. The method of claim 6, wherein the foundation comprises at least one spud can, a suction pile, a gravity base, or a portion of the seabed.

8. A self-installing offshore platform, comprising:

a hull;

a plurality of jack-up legs coupled to the hull and configured to rest of the seabed and support the hull above the seabed and raise the hull above a mean sea level; and a conductor guide support frame assembly slidably coupled to the hull that is configured to be raised or lowered independently of an elevation of the hull, comprising a structural frame and at least one conductor guide coupled to the frame, the conductor guide support frame assembly configured to be lowered to a fixed elevation to the hull and allow a conductor to pass through the conductor guide to the seabed to a fixed elevation relative to the conductor guide support frame while the conductor guide support frame assembly is suspended from the hull above the seabed.

9. The offshore platform of claim 8, wherein hydrocarbons pass through the conductor in the conductor guide from the seabed during hydrocarbon production while the conductor guide support frame assembly is suspended from the hull above the seabed.

10. The offshore platform of claim 8, further comprising a jack coupled to the hull and the conductor guide support frame assembly configured to raise the conductor guide support frame assembly relative to the hull.

11. The offshore platform of claim 8, wherein the structural frame comprises a lattice truss frame.

12. The offshore platform of claim 8, further comprising a foundation to which the offshore platform is coupled while the conductor guide support frame assembly is suspended from the hull.

13. The offshore platform of claim 12, wherein the foundation comprises at least one spud can, suction pile, gravity base, or portion of the seabed.

14. The offshore platform of claim 8, wherein the conductor guide comprises a cone having a tapering cross section area with a tube to support the conductor laterally.

* * * * *